United States Patent [19]

Mitchell et al.

[11] 4,101,417

[45] Jul. 18, 1978

[54] METHOD OF NEGATING THE EFFECTS OF METALS POISONING ON ZEOLITIC CRACKING CATALYSTS

[75] Inventors: Bruce Richard Mitchell, Sarver; Harold Eugene Swift, Gibsonia, both of Pa.

[73] Assignee: Gulf Research & Development Company, Pittsburgh, Pa.

[21] Appl. No.: 729,183

[22] Filed: Oct. 4, 1976

[51] Int. Cl.[2] ..... C10G 11/04; B01J 8/24

[52] U.S. Cl. ..... 208/120; 208/251 R; 252/416; 252/455 Z; 252/472

[58] Field of Search ..... 208/120, 113; 252/416

[56] References Cited

U.S. PATENT DOCUMENTS

| | | | |
|---|---|---|---|
| 2,480,494 | 8/1949 | Mathy | 208/121 |
| 2,901,419 | 8/1959 | Brill | 208/119 |
| 3,297,565 | 1/1967 | Garwood et al. | 208/217 |
| 3,711,422 | 1/1973 | Johnson et al. | 252/414 |
| 3,717,587 | 2/1973 | Hepner | 252/455 Z |
| 3,977,963 | 8/1976 | Readal et al. | 208/120 |
| 4,040,945 | 8/1977 | McKinney et al. | 208/113 |

*Primary Examiner*—Delbert E. Gantz
*Assistant Examiner*—G. E. Schmitkons

[57] ABSTRACT

A method of negating the effects of metals poisoning on zeolite-containing cracking catalysts which comprises compositing tin with such catalysts.

6 Claims, No Drawings

METHOD OF NEGATING THE EFFECTS OF METALS POISONING ON ZEOLITIC CRACKING CATALYSTS

BACKGROUND OF THE INVENTION

Catalytic cracking processes utilizing zeolite-containing catalyst compositions are employed to produce gasoline and light distillate fractions from heavier hydrocarbon feed stocks. Deterioration occurs in the cracking ability of the catalyst which is attributable to the deposition on the catalyst of metals introduced into the cracking zone with the feed stock. The deposition of these metals such as nickel and vanadium results in a decrease in production of the gasoline fraction. Additionally, an effect of these contaminant metals when deposited on the cracking catalyst is to increase coke production and cracking depth as demonstrated by an increase in hydrogen production.

The cracking catalysts to which the method of this invention are applicable are those zeolite-containing catalysts employed in the cracking of hydrocarbons boiling substantially above 600° F. (316° C.) for the production of motor fuel blending components and light distillates. These catalysts generally comprise a matrix which is silica or silica-alumina in association with zeolitic materials. The zeolitic materials employed can be natural occurring or synthetic and which have been ion exchanged utilizing conventional ion exchange methods with suitable cations such as the rare earths so as to improve the activity of the catalyst.

Examples of cracking catalysts to which the method of this invention is applicable include those obtained by admixing an inorganic oxide gel with an aluminosilicate composition which is strongly acidic in character as a result of treatment with a fluid medium containing at least one rare earth metal cation and a hydrogen ion or one capable of conversion to the hydrogen ion.

Petroleum charge stocks to gasoline-producing catalytic cracking processes contain metals which are generally in an organometallo form, such as in a porphyrin or naphthenate with such metals tending to be deposited in a relatively non-volatile form onto the catalyst. Those metals contained as contaminants in such petroleum charge stocks include nickel, vanadium, copper, chromium, and iron and normally comprise less than 1.5 parts per million (ppm) nickel equivalents (ppm nickel + 0.2 ppm vanadium) as metal contaminants. In continuous cracking processes when the accumulation of such metal contaminants onto the catalyst reaches approximately 1,500 ppm nickel equivalents, it is normally necessary that the catalyst be replaced to prevent loss of gasoline production and to prevent increased cracking depth as measured by an increase in hydrogen production.

SUMMARY OF THE INVENTION

Zeolite-containing cracking catalysts containing a significant concentration of tin are employed in hydrocarbon cracking processes conducted in the absence of added hydrogen wherein the concentration of metal contaminants on such catalysts exceed 1,500 ppm. The tin may be introduced into the cracking zone with the hydrocarbon feed or can be composited with the fresh zeolite-containing cracking catalyst.

DESCRIPTION OF THE INVENTION

The catalystic cracking processes of this invention are those employing zeolitic-containing catalysts wherein the concentration of the zeolite is in the range of 6 to 40 weight percent of the catalyst composite and which have a tendency to be deactivated by the deposition thereon of metal contaminants as previously described, to the extent that optimum gasoline product yields are no longer obtained. The inventive process is effective in processes employing cracking catalyst compositions which contain at least 1,500 ppm nickel equivalent metal contaminants and is generally applicable to processes wherein the cracking catalyst can contain up to 5,000 ppm nickel equivalent metal contaminants.

The cracking catalyst compositions of the process of this invention include those which comprise a crystalline aluminosilicate dispersed in a refractory metal oxide matrix such as disclosed in U.S. Pat. Nos. 3,140,249 and 3,140,253 to C. J. Plank and E. J. Rosinski. Suitable matrix materials comprise inorganic oxides such as amorphous and semi-crystalline silica-aluminas, silica-magnesias, silica-alumina-magnesia, alumina, titania, zirconia, and mixtures thereof.

Zeolites or molecular sieves having cracking activity and suitable in the preparation of the catalysts of this invention are crystalline, three-dimensional, stable structures containing a large number of uniform openings or cavities interconnected by smaller, relatively uniform holes or channels. The formula for the zeolites can be represented as follows:

$$xM_{2/n}O:Al_2O_3:1.5\text{-}6.5\ SiO_2:yH_2O$$

where M is a metal cation and $n$ its valence; $x$ varies from 0 to 1; and $y$ is a function of the degree of dehydration and varies from 0 to 9. M is preferably a rare earth metal cation such as lanthanum, cerium, praseodymium, neodymium or mixtures thereof.

Zeolites which can be employed in the practice of this invention include both natural and synthetic zeolites. These natural occurring zeolites include gmelinite, chabazite, dachiardite, clinoptilolite, faujasite, heulandite, analcite, levynite, erionite, sodalite, cancrinite, nepheline lazurite, scolecite, natrolite, offretite, mesolite, mordenite, brewsterite, ferrierite, and the like. Suitable synthetic zeolites which can be employed in the inventive process include zeolites X, Y, A, L, ZK-4 B, E, F, H, J, M, Q, T, W, Z, alpha and beta, ZSM-types and omega. The effective pore size of synthetic zeolites are suitable between 6 and 15 Å in diameter. The term "zeolites" as used herein contemplates not only aluminosilicates but substances in which the aluminum are replaced by gallium and substances in which the silicon is replaced by germanium. The preferred zeolites are the synthetic faujasites of the types Y and X or mixtures thereof.

It is also well known in the art that to obtain good cracking activity the zeolites must be in good cracking form. In most cases this involves reducing the alkali metal content of the zeolite to as low a level as possible as a high alkali metal content reduces the thermal structural stability, and the effective lifetime of the catalyst is impaired. Procedures for removing alkali metals and putting the zeolite in the proper form are well known in the art and are as described in U.S. Pat. No. 3,547,816.

Conventional methods can be employed to form the catalyst composite. For example, finely divided zeolite can be admixed with the finely divided matrix material, and the mixture spray dried to form the catalyst composite. Other suitable methods of dispersing the zeolite materials in the matrix materials are described in U.S. Pat. Nos. 3,271,418; 3,717,587; 3,657,154; and 3,676,330 whose descriptions are incorporated herein by reference thereto.

In addition to the zeolitic-containing cracking catalyst compositions heretofore described, other materials useful in preparing the tin-containing catalysts of this invention also include the laminer 2:1 layer-lattice aluminosilicate materials described in U.S. Pat. No. 3,852,405. The preparation of such materials is described in the said patent and the disclosure therein is incorporated in this application by reference thereto. When employed in the preparation of the catalysts of this invention, such laminar 2:1 layer-lattice aluminosilicate materials are combined with a zeolitic composition.

The cracking catalyst compositions of this invention also contain a concentration of tin of at least 2,000 ppm. The concentration of tin in the catalyst composite will normally range from 0.2 to 2.5 weight percent of the catalyst composite.

The tin can be added to the fresh cracking catalyst by impregnation, employing a tin compound which is either the oxide or which is convertible to the oxide upon subjecting the catalyst composite to a calcination step. For example, a compound selected from the group consisting of tetraphenyl tin, hexabutyl tin, and tetraethyl tin can be added to a hydrocarbon solvent such as benzene and the catalyst composition contacted with the hydrocarbon solvent containing the selected tin compound so as to prepare, after drying and calcination, a final catalyst composition containing a concentration of tin as defined above. When the tin compound employed in preparing the catalyst composite is selected from the group consisting of tin chloride, tin bromide, and tin sulfate, the compound can be dissolved in water and the catalyst composition contacted with the water solution so as to prepare, after drying and calcination, a final catalyst composition containing the desired concentration of tin.

Another method of adding the tin to the catalyst composite is by the addition of tin to an inorganic oxide gel. The preparation of plural gels is well known in the art and generally involves either separate precipitation or coprecipitation in which a suitable salt of the tin oxide is added to an alkali metal silicate and an acid or base, as required, is added to precipitate the corresponding oxide. The inorganic oxide gel as prepared and containing the tin can then be combined with the aluminosilicate by methods well known in the art. Another suitable method of adding the tin to the zeolite-containing catalyst composite is by a conventional ion exchange method.

An alternative method of compositing the tin with the zeolite-containing cracking catalyst is to introduce a tin compound, such as previously descried, into the hydrocarbon feed to the catalytic cracking zone until the concentration of the tin on the catalyst is at least 2,000 ppm. Generally, the rate of introduction of the tin compound in the hydrocarbon feed to the cracking zone will be such that the concentration of the tin compound will range from about 3 ppm to 3,000 ppm, preferably from 100 to 500 ppm in the hydrocarbon feed. Contacting the catalyst containing contaminating metals with the tin compound can conveniently comprise dispersing the tin compound into the hydrocarbon feed employing a suitable liquid solvent or dispersing agent. Following the compositing of the tin with the zeolite-containing catalyst, the catalyst can be further treated according to conventional methods such as heating the catalyst to elevated temperatures, generally in the range of about 800° to about 1,600° F. (427° to 870° C.) for a period of time ranging from 3 to 30 minutes in the presence of a free oxygen-containing gas. This further treatment which is effected in the catalyst regeneration step when the tin compound is introduced into the cracking zone hydrocarbon feed, results in the treating agent, if not presently in the form of the oxide, being converted to the oxide.

The catalyst compositions of this invention are employed in the cracking of charge stocks, in the absence of added hydrogen, to produce gasoline and light distillate fractions from heavier hydrocarbon feed stocks. The charge stocks generally are those having an average boiling temperature above 600° F. (316° C.) and include materials such as gas oils, cycle oils, residuums and the like. As previously described, conventional catalytic cracking charge stocks contain less than 1.5 ppm nickel equivalents as metal contaminants.

The charge stocks employed in the process of this invention can contain significantly higher concentrations of metal contaminants as the tin-containing catalysts are effective in catalytic cracking processes operated at metal contaminant levers exceeding 1,500 ppm nickel equivalents. The process employing the tin-containing catalysts is also effective at metal contaminant levels exceeding 2,500 ppm nickel equivalents and even exceeding 5,000 ppm nickel equivalents. Thus, the charge stocks to the catalytic cracking process of this invention can contain metal contaminants in the range up to 3.5 ppm and higher nickel equivalents.

Although not to be limited thereto, a preferred method of employing the catalysts of this invention is by fluid catalytic cracking using riser outlet temperatures between about 900° to 1,100° F. (482° to 593° C). The invention will hereafter be described as it relates to a fluid catalytic cracking process although those skilled in the art will readily recognize that the invention is equally applicable to those catalytic cracking processes employing a fixed catalyst bed and conventional operating conditions of temperature, pressure, and space velocity.

Under fluid catalytic cracking conditions the cracking occurs in the presence of a fluidized composited catalyst in an elongated reactor tube commonly referred to as a riser. Generally, the riser has a length to diameter ratio of about 20. The charge stock is passed through a preheater which heats the feed to a temperature of about 600° F. (316° C.) and the heated feed is then charged into the bottom of the riser.

In operation, a contact time (based on feed) of up to 15 seconds and catalyst to oil weight ratios of about 4:1 to about 15:1 are employed. Steam can be introduced into the oil inlet line to the riser and/or introduced independently to the bottom of the riser so as to assist in carrying regenerated catalyst upwardly through the riser. Regenerated catalyst at temperatures generally between about 1,100° and 1,350° F. (593° to 732° C.) is introduced into the bottom of the riser.

The riser system at a pressure in the range of about 5 to about 50 psig (.35 to 3.50 kg/cm$^2$) is normally operated with catalyst and hydrocarbon feed flowing concurrently into and upwardly into the riser at about the same flow velocity, thereby avoiding any significant slippage of catalyst relative to hydrocarbon in the riser and avoiding formation of a catalyst bed in the reaction flow stream. In this manner the catalyst to oil ratio thus increases significantly from the riser inlet along the reaction flow stream.

The riser temperature drops along the riser length due to heating and vaporization of the feed by the slightly endothermic nature of the cracking reaction and heat loss to the atmosphere. As nearly all the cracking occurs within one or two seconds, it is necessary that feed vaporization occurs nearly instantaneously upon contact of feed and regenerated catalyst at the bottom of the riser. Therefore, at the riser inlet, the hot, regenerated catalyst and preheated feed, generally together with a mixing agent such as steam, (as hereto described) nitrogen, methane, ethane or other light gas, are intimately admixed to achieve an equilibrium temperature nearly instantaneously.

The catalyst containing metal contaminants and carbon is separated from the hydrocarbon product effluent withdrawn from the reactor and passed to a regenerator. In the regenerator the catalyst is heated to a temperature in the range of about 800° to about 1600° F. (427° to 871° C.), preferably 1160° to 1260° F. (627° to 682° C.), for a period of time ranging from three to thirty minutes in the presence of a free-oxygen containing gas. This burning step is conducted so as to reduce the concentration of the carbon on the catalyst to less than 0.3 weight percent by conversion of the carbon to carbon monoxide and carbon dioxide.

Conventional processes can operate with catalysts containing contaminated metals concentrations greater than 1000 ppm nickel equivalents but at a substantial loss of product distribution and conversion. Further, under such conditions undesirably high concentrations of coke, hydrogen and light gas are produced. By employing the defined catalyst in the manner of this invention, the contaminant metals level on the catalyst can exceed 2500 ppm nickel equivalents while obtaining a conversion and gasoline yield normally effected by conventional catalysts containing only 500 ppm nickel equivalent metal contaminants.

Gasoline yield is not significantly reduced as metals contaminant levels increase up to 5,000 ppm nickel equivalents. Although hydrogen yields increase with increasing metal contamination above 1500 ppm, the rate of increase is substantially less than that normally obtained in conventional hydrocarbon cracking processes. Thus, by this invention the cracking process can be operated efficiently with a metal contaminant concentration level on the catalyst up to at least 5000 ppm nickel equivalents.

As previously indicated, the process of this invention has a significant advantage over conventional catalytic cracking processes by providing an economically attractive method to include higher metals-containing gas oils as a feed to the catalytic cracking process. Because of the loss of selectivity to high value products (loss of conversion and yield of gasoline, and gain in coke and light gases) with the increase in metals contamination on conventional cracking catalysts, most refiners attempt to maintain a low metals level on the cracking catalyst -- less than 1000 ppm. An unsatisfactory method of controlling metals contamination in addition to those previously discussed is to increase the catalyst makeup rate to a level higher than that required to maintain activity or to satisfy unit losses.

The following examples are presented to illustrate objects and advantages of the invention. However, it is not intended that the invention should be limited to the specific embodiments presented therein.

EXAMPLE I

In the catalytic cracking run, conducted in the absence of added hydrogen, of this Example, a Kuwait gas oil feed stock having a boiling range of 500° F. (260° C.) to 800° F. (427° C.) was employed. The catalyst employed was a crystalline aluminosilicate dispersed in a refractory oxide matrix wherein the concentration of the zeolite was in the range of 30 – 40 weight percent. The physical characteristics and chemical composition of the catalyst containing 0.25 weight percent nickel and 0.035 weight percent vanadium for a total of 2,570 ppm nickel equivalents as metal contaminants was as follows:

| Physical Characteristics: | after heating in the presence of oxygen for 3 hours at 552° C. |
|---|---|
| Surface Area: $m^2/g$ | 193 |
| Pore Volume: cc/g | 0.222 |
| Apparent Bulk Density: $kg/dm^3$ | 0.716 |
| Volatile Content: 2 hrs. at 1500° F. | 12.3% |
| Particle Size Distribution | |
| 0–20 Microns | 3.0 |
| 20–40 Microns | 12.8 |
| 40–80 Microns | 52.7 |
| > 80 Microns | 31.5 |
| Chemical Composition: wt. % | |
| Iron ($Fe_2O_3$) | 0.543 |
| Nickel (Ni) | 0.25 |
| Vanadium (V) | 0.035 |
| Sodium (Na) | 0.62 |
| Alumina ($Al_2O_3$) | 42.15 |
| Cerium (Ce) | 0.19 |

The catalytic cracking run of this Example was conducted employing a fixed catalyst bed, a temperature of 900° F. (482° C.), a weight hourly space velocity of 15, and a contact time of 80.5 seconds. The results obtained in this Run (Run No. 1) were a conversion of 56.2 volume percent of the feed, a $C_5$ + gasoline production of 36.0 volume percent of the feed, a production of 5.47 weight percent carbon on the catalyst and a hydrogen yield of 0.44 weight percent of the feed.

EXAMPLE II

In this Example the effectiveness of employing a cracking catalyst when processing the Kuwait gas oil of Example I is demonstrated. In Run No. 2 the catalyst composition of Example I containing 2,570 ppm nickel equivalents as metal contaminants was impregnated with hexabutyl tin to obtain a catalyst composite containing 0.61 weight percent tin. In Run No. 3 the fresh catalyst composition of Example I was impregnated with tin chloride to obtain a catalyst composite containing 0.61 weight percent tin and the catalyst thereafter contaminated with 2,570 ppm nickel equivalents as metal contaminants. The cracking conditions employed in each of Runs 2 and 3 were the same as those employed in Run No. 1 of Example I. The results obtained in each of the runs, together with the results otained in Run No. 1, are shown below in Table I.

TABLE I

| Run No. | Conversion Vol % of Feed | $C_5^+$ Gasoline Vol % of Feed | Carbon Wt % of Feed | Hydrogen Wt % of Feed |
|---|---|---|---|---|
| 1 | 56.2 | 36.0 | 5.47 | .44 |
| 2 | 60.3 | 40.1 | 5.06 | .28 |
| 3 | 63.9 | 42.6 | 4.58 | .28 |

A comparison of the results obtained demonstrates the effectiveness of the catalyst composition containing tin to obtain significant improvement in the conversion and in $C_5+$ gasoline produced when operating with metal contaminants on the catalyst equal to 2,570 ppm nickel equivalents. Also, the effectiveness of a tin-containing catalyst to significantly reduce the production of carbon and hydrogen is demonstrated.

Although the invention has been described with references to specific embodiments, references, and details, various modifications and changes will be apparent to one skilled in the art and are contemplated to be embraced in this invention.

We claim:

1. In a process which comprises contacting a hydrocarbon feed with a zeolite-containing cracking catalyst containing at least 1,500 ppm nickel equivalents as metal contaminants in a cracking zone under cracking conditions without added hydrogen to produce a gasoline fraction; the improvement which comprises contacting said catalyst with a tin compound so as to deposit at least 2,000 ppm tin on said catalyst.

2. The process of claim 1 wherein said tin compound is contacted with a zeolite-containing cracking catalyst substantially free of metal contaminants prior to introduction of said catalyst into said cracking zone.

3. The process of claim 1 wherein the tin compound is convertible to the oxide and is introduced into said cracking zone with said hydrocarbon feed.

4. The process of claim 3 to include the step of thereafter heating said catalyst to a temperature in the range of about 800° to about 1,600° F.

5. The process of claim 1 wherein contact between said tin compound and said catalyst is maintained until a concentration of tin on said catalyst in the range of about 0.2 to about 2.5 weight percent is obtained.

6. The process of claim 1 wherein said cracking catalyst is contacted with a tin compound selected from the group consisting of hexabutyl tin and tin chloride.

* * * * *